United States Patent [19]

Cope

[11] 4,203,819

[45] May 20, 1980

[54] ELECTROLYTIC CELL WITH FLOW DETECTION MEANS

[75] Inventor: Steven A. Cope, North Little Rock, Ark.

[73] Assignee: E. I. Du pont de Nemours and Company, Wilmington, Del.

[21] Appl. No.: 872,666

[22] Filed: Jan. 26, 1978

[51] Int. Cl.[2] ..... C25C 3/14; C25C 3/02; C25C 7/00

[52] U.S. Cl. ..... 204/247; 204/68; 204/237

[58] Field of Search ..... 204/68, 243 R–247, 204/237

[56] References Cited

U.S. PATENT DOCUMENTS

| | | | |
|---|---|---|---|
| 2,629,688 | 2/1953 | Hunter et al. | 204/245 X |
| 2,902,415 | 9/1959 | Niedrach et al. | 204/245 X |
| 4,089,770 | 5/1978 | Lemke | 204/247 |

FOREIGN PATENT DOCUMENTS

| | | | |
|---|---|---|---|
| 898818 | 12/1953 | Fed. Rep. of Germany | 204/245 |
| 387028 | 10/1973 | U.S.S.R. | 204/245 |

*Primary Examiner*—L. Dewayne Rutledge
*Assistant Examiner*—D. R. Valentine

[57] ABSTRACT

An electrolytic cell is provided for the electrochemical separation of selected metals from electrodissociatable compounds thereof in the molten state utilizing as electrode separator a plurality of solid electrolyte tubes which, under the influence of an electrical potential, are permeable to the flow of selected cations, but impermeable to fluids and the flow of anions and other cations. Means are provided with each tube for detecting the flow of molten metal from each solid electrolyte tube to a molten metal collection zone associated with the cell.

6 Claims, 6 Drawing Figures

ELECTROLYTIC CELL WITH FLOW DETECTION MEANS

RELATIONSHIP TO OTHER APPLICATIONS

This application is related to coassigned application Ser. No. 814,432, filed July 11, 1977, now U.S. Pat. No. 4,089,770, in the name of Charles H. Lemke.

BACKGROUND OF THE INVENTION

1. Field of Invention

The invention relates to improved electrolytic cells for the separation of alkali metals from electrodissociatable compounds in the molten state and more particularly to molten metal flow detection in such cells.

2. Prior Art

The metals most frequently made by electrolysis of electrodissociatable compounds in the molten state are the alkali metals, particularly sodium and lithium.

The type of electrolytic cell most widely used for the production of sodium metal is the Downs cell, which is described in U.S. Pat. No. 1,501,756 to J. C. Downs. The Downs-type electrolytic cell basically is comprised of a refractory-lined steel shell for holding the molten salt electrolyte, a submerged cylindrical graphite anode surrounded by a cylindrical steel cathode and a perforated steel diaphragm positioned in the annular space between the electrodes to separate the anode and cathode products. To collect product halogen gas from the anode, the cell is provided with collector means such as an inverted cone which fits over the anode below the surface of the molten bath. Halogen gas (usually chlorine) passes upwardly through the cone and, via appropriate manifold components, from the cell. Similarly, the cathode is also provided with collector means such as an inverted inclined trough which fits over the cathode below the surface of the molten bath. Molten alkali metal rises from the cathode toward the surface of the molten bath, is collected along the inclined surface of the trough and is passed to a vertical riser/cooler in which the molten metal is partially cooled before it is passed to a product receiver.

Despite the current technical and economic superiority of the Downs cell for making alkali metals, particularly sodium and lithium, the cell nevertheless has several disadvantages which are becoming even more highly significant as additional emphasis is placed on energy conservation and the quality of working environment for operating personnel.

A most promising route by which the disadvantages of the prior art can be overcome is to employ an electrolytic process in which a solid electrolyte material, which, under the influence of an electrical potential, is permeable to the flow of selected cations, but impermeable to the flow of other species, i.e., fluids, anions and other cations, to separate the anode and cathode compartments of the cell. A basic method for carrying out the electrowinning of alkali metals in this manner is disclosed in U.S. Pat. Nos. 3,404,036 and 3,488,271 to Kummer et al. in which a flat plate of sodium beta alumina is used as the solid electrolyte material. A similar method is disclosed in U.S. Pat. No. 3,607,684 to Kuhn in which sheets of beta alumina are used as a diaphragm to separate the anode and cathode compartments of the electrolytic cell.

Though the cells of the prior art, which have employed solid electrolyte material as a separator between the cathode and anode, are effective in carrying out the electrolytic separation of metals from molten salts thereof, such cells have remained largely undeveloped and lack the configuration necessary to obtain efficient continuous operation on a commercial basis. In particular, the cells of the prior art have not been of such design as to provide for safe continuous cell operation in the event of breakage of the fragile solid electrolyte material, nor do such prior art cells permit efficient use of electrical energy and factory floor space by providing an acceptable ratio of solid electrolyte surface area to cell volume.

SUMMARY OF THE INVENTION

According to the present invention there is provided in a cell for the electrochemical separation of metals from electrodissociatable compounds thereof in the molten state having (a) an enclosed shell having top, bottom and side members;

(b) a molten metal collection zone comprising (1) an upper horizontal fluid-tight partition positioned below the top of the cell, the partition having a plurality of open risers extending above the upper surface of the partition, the riser tubes being in fluid communication with (2) a plurality of corresponding solid electrolyte tubes suspended from the upper partition, the tubes being joined to the upper partition in fluid-tight relationship at the upper end and closed at the lower end, (3) negative current collector means extending into the upper end of each of the solid electrolyte tubes, and (4) outlet means for removing molten metal in the collection zone from the cell; and (c) an electrolyte circulation zone beneath the upper horizontal partition comprising (1) a plurality of positive pole assemblies, each connected with positive current collector means, positioned concentrically to the outer longitudinal surface of each of the solid electrolyte tubes, (2) outlet means for removing gas from the electrolyte circulation zone near the top thereof, and (3) inlet means for feeding electrolyte feed materials into the circulation zone, the improvement which comprises: means for detecting the flow of molten metal from each solid electrolyte tube to the molten metal collection zone.

DETAILED DESCRIPTION OF THE INVENTION

Figure 1:
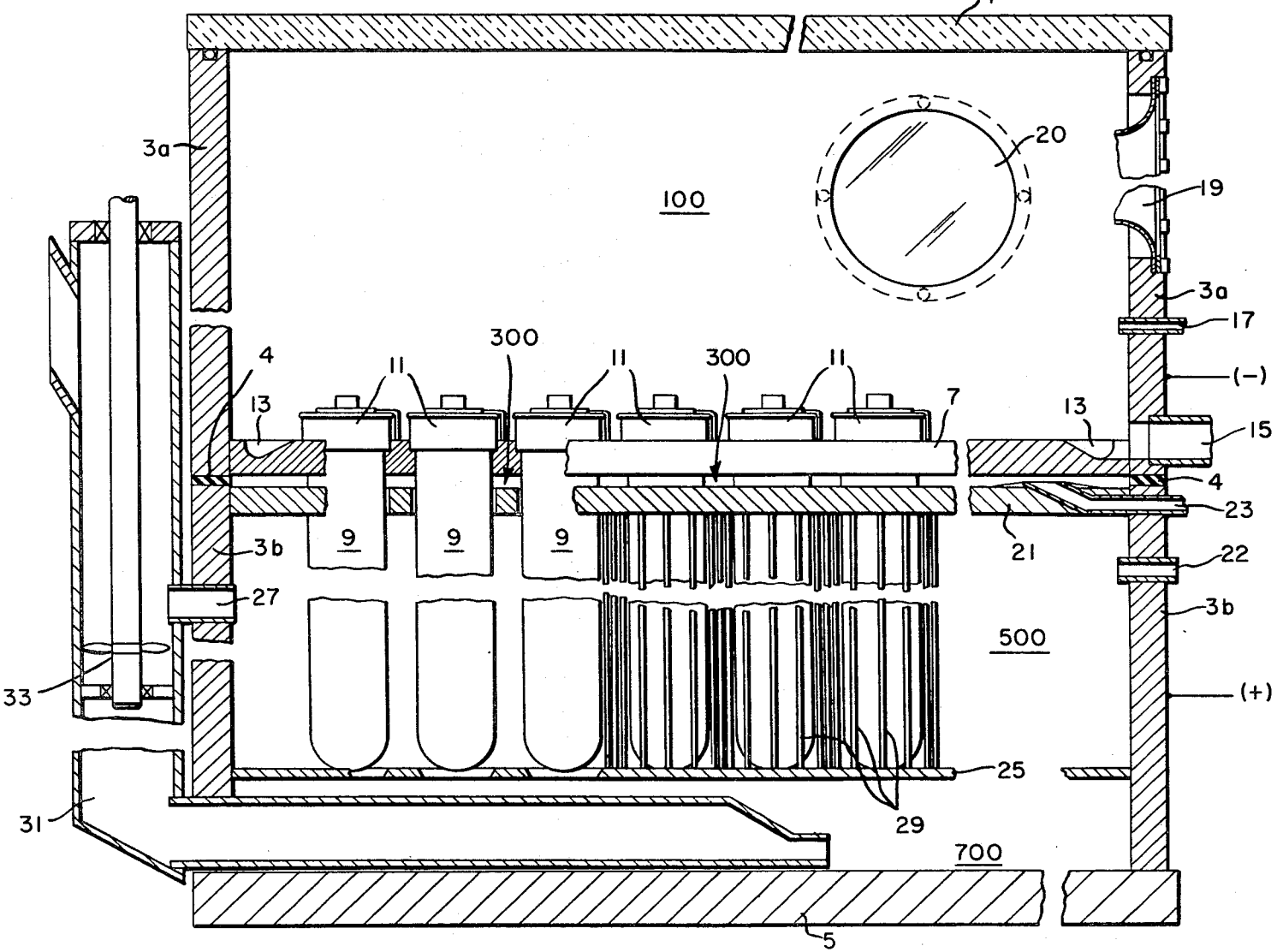
FIG. 1 is a cross-sectional view of an electrolytic cell having a plurality of solid electrolyte tubes.

The present invention is an improvement in the electrolytic cell described in the aforesaid U.S. Ser. No. 814,432, filed July 11, 1977, the disclosure of which is herein incorporated by reference. As described therein and with reference to FIGS. 1 and 2, there is shown a cell comprising in combination an enclosed shell having a topwall (1), upper and lower sidewalls (3*a* and 3*b*, respectively) and a bottom wall (5). The topwall member (1) is constructed of transparent material, such as glass, to permit viewing into upper collection zone (100), which is formed by an upper horizontal fluid-tight partition (7) positioned below the top of the cell and extending between the upper sides of the cell (3*a*). The upper horizontal fluid-tight partition (7) functions as a tube sheet having joined thereto and suspended therefrom a plurality of cylindrical tubes (9), closed at the lower end and made of solid electrolyte material which is permeable to the flow of monovalent cations, such as $Na^+$, but impermeable to the flow of fluids, anions and polyvalent cations. Solid electrolyte materials are known in the art and include fragile glasses and polycrystalline ceramics. Any such material can be used in practicing the present invention, but at the present time, beta-alumina type materials appear to have the edge as the preferred solid electrolyte.

The tubes are positioned and supported on the upper horizontal partition by means of open riser (11) which is joined in a fluid-tight manner to the partition. Though the tubes are closed at their lower ends, they are in fluid communication with the upper collection zone (100) at their upper ends in such manner that monovalent metal formed at the inner surface of the tubes is collected in the tube and rises within the tubes to overflow onto the top surface of the upper partition (7). The risers do, however, perform the additional function of acting as a barrier or dam for the molten sodium. Thus, in the event one of the solid electrolyte tubes is broken below the tube sheet, the molten sodium atop the tube sheet will not flow into the electrolyte, but will be retained.

The risers can take several forms. For example, the upper part of the solid electrolyte tube itself or an extension thereof can be positioned in the tube sheet so that the upper part of the tube extends above the desired level of molten metal. On the other hand, short ring-like riser tubes can be mounted atop the tube sheets which are adapted to function as sleeve supports into which the electrolyte tubes are inserted from above. This latter configuration is preferred since utilization of the tube itself as riser entails the possibility that the riser portion of the electrolyte tube might also be broken and thus would fail in its function as a dam.

Monovalent metal flowing onto the top of the upper partition (7) is removed from the cell via collecting channels (13) through outlet line (15). During normal operation of the cell, an inert atmosphere is maintained in the upper collection zone by maintaining a small flow of inert gas which is provided via inert gas inlet line (17), preferably at a slight positive pressure.

The upper collection zone (100) is also equipped through wall (3*a*) with access means comprising a glove assembly (19) and access port (20) by which certain maintenance functions can be carried out within the upper collection zone (100) without having to remove the top member (1). In particular, when a tube fails, it is removed from the tube sheet using glove assembly (19). Access port (20), which during normal operation is sealed by means of a flange and bolted cover, is then opened and the failed tube is removed therethrough. The replacement tube can then be inserted into the metal collecting zone via the open access port (20). The access port is then resealed and the replacement tube is placed into operating position using glove assembly (19). During this operation, it will usually be preferred to purge the chlorine collection zone with inert gas which is supplied via a second inert gas inlet (22). In place of the bolted flange and cover used here, an air lock assembly might also be used.

In the cell illustrated in the Drawings, the open ends of the solid electrolyte tubes (9) (or inert extensions thereof) protrude above the surface of the tube sheet (7) and are supported atop the tube sheet by riser (11) above the desired liquid level on the sheet. By this arrangement, when a tube is broken, molten metal in the metal collection zone will drain off in its usual path and will not drain into the electrolyte circulation zone through any opening left by the fractured tube.

The upper horizontal partition (7) as well as the upper sidewalls of the cell (3*a*) are constructed of electrically conductive material and together function as negative current collector for the cell. The upper part of the cell is insulated electrically from the lower part of the cell by means of an insulating gasket (4) placed between the abutting edges of the upper and lower cell sidewalls. Also, in order to keep the chlorine and sodium from recombining, it is necessary that the junction of the upper horizontal partition with the cell sidewalls, as well as the junction between the walls of each tube with the tube sheet or riser be fluid-tight, thus preventing the gas produced outside the tubes from entering the metal collection zone.

An intermediate horizontal partition (21) extending between the lower sides of the cell (3*b*) is positioned below the upper horizontal partition (7), thus forming a lower second collection zone (300) in which gas formed outside the solid electrolyte tubes (9) is collected. Gas within zone (300) is removed from the cell through gas outlet line (23). As in the operation of conventional Downs cells, it is preferred to maintain a slight vacuum on this line to prevent seepage of halogen gas into the work areas in which the cells are located. The intermediate horizontal partition is perforated in such manner that an annular space is formed between the edge of the perforations and the outer surfaces of the solid electrolyte tubes (9) near the upper end thereof.

It should be noted that the depth of the gas collection zone (300) can be increased substantially without sacrificing tube electrolysis area by adding an inert tube extender to the open ends of the solid electrolyte tubes. For example, an $\alpha$-alumina tubular extension of appropriate length can be cemented to the upper end of the tubes by means of a sintered glass cement, a glass joint formed by melting glass between the two alumina surfaces or by use of ceramic cements of various types.

Positioned near the closed lower end of the solid electrolyte tubes is a lower horizontal partition (25) which, with the intermediate partition (21), forms an electrolyte circulation zone (500) surrounding the solid electrolyte tubes (9). The lower horizontal partition (25) is also provided with perforations through which molten electrolyte flows into the zone and around the solid electrolyte tubes. Molten electrolyte is discharged from circulation zone (500) through liquid electrolyte discharge line (27).

Extending between the intermediate and lower horizontal partitions (21, 25) in close proximity with each solid electrolyte tube (9) is a positive pole assembly comprised of a plurality of metal rods (29) positioned in a concentric circular array around the solid electrolyte tube (9). In the cell illustrated in FIG. 1, both the intermediate partition (21) and the lower sidewall (3b) are constructed of electrically conductive material and together function as positive current collector for the cell. The lower ends of the metal rods are anchored to lower horizontal partition (25) in order to assure accurate positioning of the rods with respect to the outer wall of the solid electrolyte tubes (9).

The positive pole assemblies can take many forms. For example, the positive pole assembly can be a nonforaminous cylindrical surface of anode material or it can consist of a concentric circular array of anode rods surrounding the electrolyte tubes. A perforate material such as gauze or wire mesh fabricated of anode material into tube form can also be used. When the above-described rod-type positive pole assembly is used, it is contemplated that many of the rods can be shared by two or more solid electrolyte tubes. For example, in a cell containing an hexagonal array of tubes each utilizing a positive pole assembly consisting of 18 rods, at least 6 of those can be shared with other electrolyte tubes.

The anode rods do not have to be constructed of solid positive pole material. For example, an anode metal can be plated on a less expensive substrate rod or the anode may consist of inert plastic filled with finely divided particles of positive pole material. In another variation, the positive pole can be constructed of metal wrapped in graphite felt.

Tungsten is a preferred positive pole material from the standpoint of operational life if a liquid electrolyte consisting of a mixture of sodium chloride and aluminum chloride is used. However, other conductive materials can also be used as anodes for this electrolyte, for example, certain forms of carbon such as graphite felt. As will be apparent to those skilled in the electrowinning art, the choice of anode will depend greatly upon the characteristics of the particular liquid electrolyte and the products therefrom.

The positive pole assemblies, of course, should be supported in such manner to assure that they are substantially concentric with the electrolyte tubes. The positive pole assemblies can be suspended from an intermediate horizontal partition positioned a short distance below the upper horizontal partition in the vapor space above the liquid electrolyte. When the positive pole assemblies are supported in this manner, the intermediate partition must contain a number of perforations which correspond to and are concentric with each of the tubes within the cell. The perforations are slightly larger than the tubes, by which an annulus is formed between the inner edges of the perforations and the outside wall of the solid electrolyte tubes. The intermediate partition is preferably located as near as possible to the top of the tubes in order not to waste usable tube electrolysis area. On the other hand, the volume of the zone formed between the upper and intermediate partitions should be sufficient to provide adequately for disengagement of the gas released at the anode assemblies, which is removed from the cell by means of the gas outlet means located within this collection zone.

Alternatively, the positive pole assemblies can be supported on a lower horizontal partition near and preferably at or below the closed end of the electrolyte tubes. In addition to its function as a support for the lower end of the positive pole assembly, the lower horizontal partition may serve to facilitate even flow of molten salt electrolyte around the solid electrolyte tubes. Patterns of molten salt flowing through the cell will, of course, vary extensively depending upon the particular tube size, anode geometry and the array of tubes and anodes.

Those skilled in the art will recognize that it is important that the anode assemblies be spaced uniformly from the cathode in order to achieve uniform current density. Furthermore, it has been found that the life of the solid electrolyte is shortened by excessively high current density. For these reasons, in order to operate at high current densities consistent with acceptable tube life, it is preferred that the concentricity of the anode assemblies be uniform. To do this, it may in some instances be desired to support the anode assemblies at both the upper and lower ends from an upper and lower horizontal partition. This is especially true if the anode assemblies are constructed from less rigid materials.

When the partitions used to support the anode assemblies also function as a positive current collector for the cell, the partitions are constructed of suitable conductive material which will withstand the corrosive environment. The anode can be attached by such means as welding, brazing, staking, screwed connections and the like. In a manner analogous to the upper horizontal partition, when the intermediate partition is used as the positive current collector, it must be insulated from the cathodic components of the cell. This can quite conveniently be accomplished for both instances by constructing the cell in two sections—an upper cathodic section and a lower anodic section—which are electrically insulated from each other by means of insulating gaskets between the sections.

The lower horizontal partition (25) separates the circulation zone of the cell (500) from a molten salt inlet zone (700). Feed materials are passed to the cell through feed line (31). A positive flow of salt feed and recirculation of molten salt is maintained by operation of impeller assembly (33), which is located within the salt feed line (31). Circulation and distribution of salt is aided by the liberation of halogen gas in the anode-cathode cell which then rises to the top of the anode section.

Figure 2:
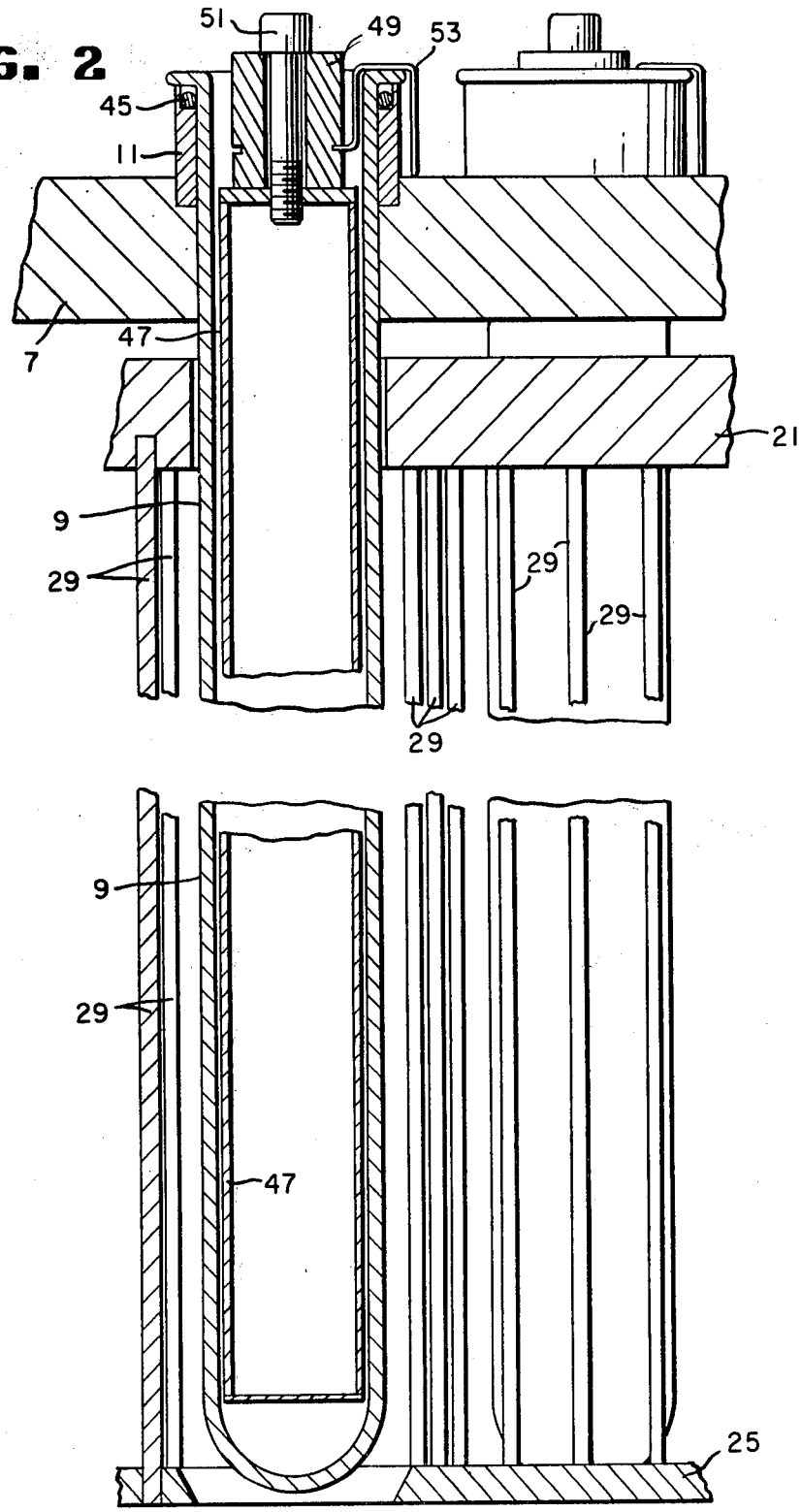
FIG. 2 is a detailed cross-sectional view of solid electrolyte tubes and positive pole assemblies.

FIG. 2 is a detailed representation of the solid electrolyte tube and positive pole assemblies. Solid electrolyte tube (9) is supported atop upper horizontal partition (7) by means of riser (11), which is made of the same conductive material as the upper horizontal partition. A fluid-tight relationship between the outside of the solid electrolyte tube and the sodium collection zone atop partition (7) is maintained by O-ring gasket (45).

Positioned within the solid electrolyte tube (9) is a tubular insert (47) and insulating ring (49), which serve to displace and thus reduce the volume of sodium which is contained in the cell by limiting it to the volume of the small annulus between the inner wall of the electrolyte tube (9) and the outer wall of the sodium displacement tube (47). Since the tubes (9) are usually fragile and can also weaken in use, such a reduced volume will minimize any violent reaction which may occur when a tube undergoes catastrophic failure such as fracture and causes molten metal therein to be released and flow into the anode area and react with liquid electrolyte or with chlorine released at the anodes.

It is preferred that displacement means (47) be supported independently of the tubes so that, in the event of tube breakage or other catastrophic tube failure, the displacement means will not drop into the molten electrolyte bath surrounding the tubes. This is quite readily accomplished by suspending through the open top end of the tubes a displacement insert made of inert material having an outer wall shape which conforms approximately with the inner wall shape of the electrolyte tube, but which is spaced therefrom so as to form a narrow annular space therebetween through which the molten metal can flow upwardly over the lip of the tube onto the surface of the molten metal collection zone. The molten metal displacement means can be made of any material which has suitable strength under the conditions of cell operation and which is inert with respect to both the liquid electrolyte and the molten metal. In the manufacture of sodium, iron, stainless steel, NaCl and $\alpha$-alumina are very suitable displacement materials. Others include metal powders, felt, gauze or pellets and carbon black. Either solid or hollow shapes can be employed. When particulate solids are used for this purpose, they can be retained in an inert gauze sack or other suitable container.

As is shown in FIG. 2, the displacement tube (47) is positioned and supported within the solid electrolyte tube (9) by a support assembly comprising ring (49) which is affixed to the displacement tube (47) by cap screw (51). Ring (49) is grooved around its circumference to accommodate an electrically conductive clip (53) which serves to support and position the displacement tube (47) and support assembly within the solid electrolyte tube (9). The clip also serves to assure an electrically conductive path between the molten sodium metal within the solid electrolyte tube (9) and the upper horizontal partition (7), the latter of which also functions in this instance as the negative current collector (cathode) for the cell.

The above assembly also functions as a switch to shut off electrical flow to the tube when the molten metal level drops below the level of the conductive clip, for example, when the tube is fractured. By looking through glass top member (1), it can be determined whether the tubes are operable or whether they are operating at a reduced rate. In the event that this does happen with a given tube assembly, the tube can be switched "off" by lifting the tube insulating ring (49), insert (47), and clip (53) a short distance, e.g., 1 cm, which has the effect of lifting the lower end of clip (53) out of contact with the molten sodium on the upper surface of partition (7), thereby breaking the electrical circuit. Subsequently, the components may be removed and replaced, as necessary, by functional ones, preferably after purging the chlorine collection zone.

For purposes of safety and the control of convection and radiation losses from the cell when it is in operation, it is preferred that portions of the cell be insulated on the outside with an appropriate insulation material such as magnesia or fiberglass. Especially when the cell is suitably insulated, those skilled in the art will recognize that the cell requires no separate heat source during operation and that an integral source of heat may not be required for startup. However, a heat source can be incorporated into the reaction vessel if desired. For example, electric heating elements can be affixed to the outer surface of the lower sidewalls or bottom of the cell.

As noted earlier, an operator must keep all solid electrolyte tubes (9) under visual surveillance at intervals of time to determine whether individual tubes are producing, not producing or producing such minute quantities of liquid sodium as to require replacement (the latter, for example, due to deposits on the outside of the tubes). In an operating tube (9), the liquid sodium being produced will rise to the very top of the tube and spill over to fall to the upper face of the upper horizontal tube sheet (7); however, since maximum flow rates for a properly operating tube now planned for commercial production only amount to about 2 to 10 cc/min of sodium, it is difficult to discern visually the rate of flow or even the absence of flow. Thus, the present invention, as shown in FIGS. 3, 4, 5 and 6, is intended to make it possible for an operator to assess the flow situation of individual tubes (9) in a quick and easy manner.

Figure 3:
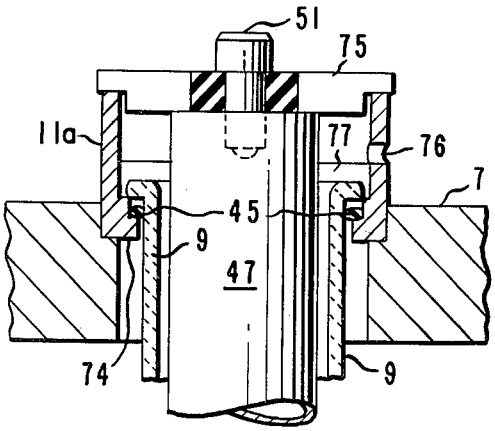
FIG. 3 is a cross-sectional view of the top of one solid electrolyte tube illustrating one embodiment of the invention taken along line 3—3 of FIG. 4.
Figure 4:
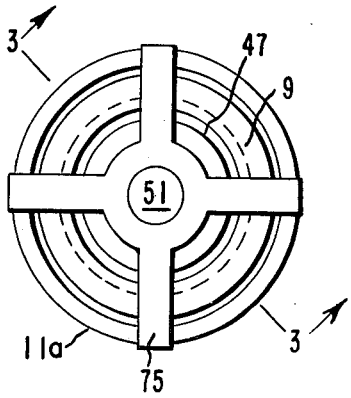
FIG. 4 is a top view of the tube of FIG. 3.

Referring to FIGS. 3 and 4, a flanged solid electrolyte tube (9) is supported from an electrically conductive open riser (11*a*) having an integral internal flange (74); a liquid-tight seal is effected between tube (9) and riser (11*a*) by means of an O-ring gasket (45). Hanging within the tube (9) is an electrically conductive displacement tube (47) which extends slightly above the upper end of the tube (9) to be supported by an electrically insulating cap (75) which rests on riser (11*a*), the assembly being secured by means of screw (51). The cap (75) is not a solid disk but has a central hub and radial arms with spaces therebetween; the ends of the arms engage riser (11*a*). In the wall of the riser (11*a*) is a single orifice (76), the bottom edge of which is slightly (e.g., 2 mm) above the topmost part of tube (9).

When the tube shown in FIGS. 3 and 4 is in operation, the tube (9) will produce liquid sodium which then rises to the level (77) thereafter spilling out through orifice (76) to fall to upper surface of the partition tube sheet (7). The orifice (76) is sized (e.g., approximately at 1 mm diameter orifice) to permit egress of a minimum acceptable quantity of liquid sodium that a tube (9) will produce; thus, since the normal production rate of sodium is in excess of that carried off via orifice (76), the liquid level will rise above orifice (76) and most of the sodium produced will normally spill over the top of the riser (11*a*) via the openings between the support arms of cap (75). The liquid level will stabilize there, a level easily observed by an operator. If the sodium production rate falls to or below the minimum acceptable rate, the level will fall below the top of riser (11*a*) and the sodium will then either emerge only from the orifice (76), a condition easily observed by the operator, or not emerge at all. If either condition is reached, this, of course, is an indication of a tube malfunction and the tube (9) should be replaced to regain maximum production.

Figure 5:
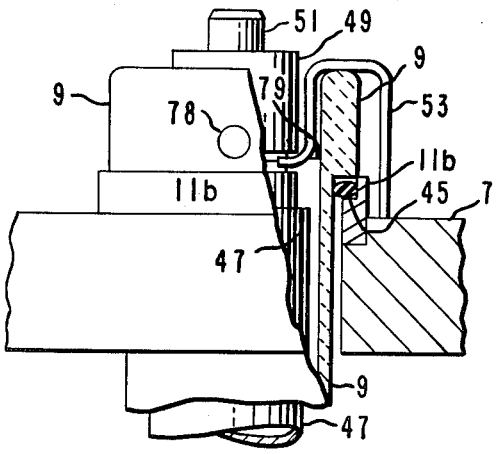
FIG. 5 is a partial cross-sectional view of the top of one solid electrolyte tube illustrating a second embodiment of the invention.

Referring to the embodiment shown in FIG. 5, solid electrolyte tube (9) is sealed by means of O-ring gasket (45). The upper end of tube (9) is flanged so that the bottom of the flange rests on the top of the riser (11*b*); however, the flanged portion is made appreciably thicker than in other embodiments so as to provide room between the top and bottom of the flange for an orifice (78) which is sized for minimum acceptable flow rate as described above for the embodiment of FIGS. 3 and 4 and which extends entirely through the flange to the interior of the tube (9). The remaining parts used in the embodiment of FIG. 5 are substantially the same as in the cell shown in FIG. 2, e.g., the displacement tube (47), the insulating ring (49), the screw (51) and the electrically conductive clip (53). As sodium is produced, the liquid will rise to level (79) and then start to emerge from orifice (78). As with the embodiment shown in FIGS. 3 and 4, most of the sodium will spill over the top of tube (9), thus concentrating the flow of liquid sodium to that one location, visual observation thus being made easier.

Figure 6:
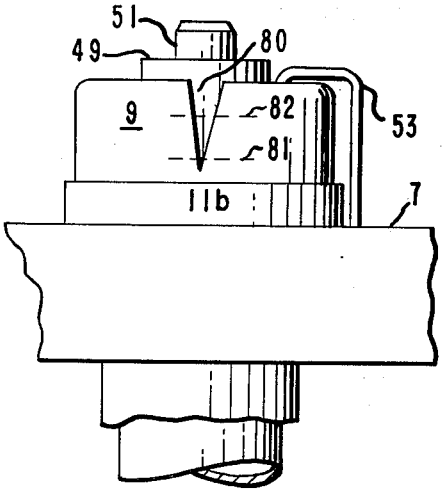
FIG. 6 is a side elevational view of the top of one solid electrolyte tube illustrating a third embodiment of the invention.

In another embodiment, FIG. 6, all parts are substantially identical to those of FIG. 5 except that the thickened flange of tube (9) is provided with a V-notch weir (80) (instead of an orifice (78)) which passes entirely through the flange. When this cell is started up, the liquid sodium level rises and at about line (81), the sodium will start to flow out of weir (80). At "normal" sodium production rates under steady-state conditions, the level might have to rise to about line (82) in order to allow all of the sodium being produced to emerge; however, should the production rate fall, but not stop (e.g., due to tube fouling), the liquid level will fall below the line (82), a change in level easily perceived by an operator.

Operating Procedures

When the above-described cell is assembled and the appropriate feed, product and electrical connections are made, startup of the cell is quite easy. This is illustrated by the following procedure for starting up and operating the cell for the manufacture of sodium from an approximately equimolar mixture of NaCl and $AlCl_3$.

Appropriate quantities of granular NaCl and $AlCl_3$ are fed to a solids blender, such as a ribbon mixer, to form a uniform mixture of the two materials. The thusly mixed granular salts are then placed in a suitably heated melt tank in which they are melted by heating to 200°-250° C., which is well above the solidus of the bath. The molten salt feed mixture is pumped to the inlet of the cell and the circulation zone is filled up to the level of the electrolyte discharge line. Circulation of the feed through the cell is then established.

After bath circulation is started, the space within the molten metal collection zone is purged with inert gas and the solid electrolyte tubes are then filled with molten sodium to a level sufficient to provide electrical contact with the upper horizontal partition.

The cell is then started merely by turning on the power to the cell which can be done either gradually or fully at once. Operation of the cell is then continued with either continuous or batch addition of granular NaCl to the cell at a rate to maintain the NaCl composition of the molten salt bath at the desired level.

The described cell, when making sodium at 200° C., operates at a voltage of 6 as compared to about 7 for conventional Downs cells making sodium at 600° C. Average current (coulombic) efficiency for the cell is essentially 100% compared to a range of 80–90% for Downs cells. Power consumption of the cell at the same productivity is about 30% lower than the Downs cell.

After extended operation of the cell, some of the electrolyte tubes may become less efficient because the sodium ion passages become blocked with extraneous ions. In some instances of such blockage, the degree of blockage may be reduced by reversing the polarity of the cell for a short time. Thus, tube life can frequently be extended in this way.

Whenever any of the tubes in the cell are broken and/or have to be replaced for any reason, power to the cell is cut off and the chlorine is purged out of the collection zone with inert gas. The inert atmosphere in the metal collection zone is also maintained during this operation. Tubes are then replaced in the manner described hereinabove in the description of the Drawings.

What is claimed is:

1. In a cell for the electrochemical separation of metals from electrodissociatable compounds thereof in the molten state having
   (a) an enclosed shell having top, bottom and side members;
   (b) a molten metal collection zone comprising
      (1) an upper horizontal fluid-tight partition positioned below the top of the cell, the partition having a plurality of open risers extending above the upper surface of the partition, the riser tubes being in fluid communication with
      (2) a plurality of corresponding solid electrolyte tubes suspended from the upper partition, the tubes being joined to the upper partition in fluid-tight relationship at the upper end and closed at the lower end,
      (3) negative current collector means extending into the upper end of each of the solid electrolyte tubes, and
      (4) outlet means for removing molten metal in the collection zone from the cell; and
   (c) an electrolyte circulation zone beneath the upper horizontal partition comprising
      (1) a plurality of positive pole assemblies, each connected with positive current collector means, positioned concentrically to the outer longitudinal surface of each of the solid electrolyte tubes,
      (2) outlet means for removing gas from the electrolyte circulation zone near the top thereof, and
      (3) inlet means for feeding electrolyte feed materials into the circulation zone, the improvement which comprises at least one opening in the wall of each electrolyte tube for visually detecting the rate of flow of molten metal from the tube to the molten metal collection zone.

2. The cell of claim 1 wherein the opening is a substantially circular orifice in the tube wall.

3. The cell of claim 1 wherein the opening is a weir formed at the upper end of the tube.

4. In a cell for the electrochemical separation of metals from electrodissociatable compounds thereof in the molten state having
   (a) an enclosed shell having top, bottom and side members;
   (b) a molten metal collection zone comprising
      (1) an upper horizontal fluid-tight partition positioned below the top of the cell, the partition having a plurality of open risers extending above the upper surface of the partition, the riser tubes being in fluid communication with
      (2) a plurality of corresponding solid electrolyte tubes suspended from the upper partition, the tubes being joined to the upper partition in fluid-tight relationship at the upper end and closed at the lower end,
      (3) negative current collector means extending into the upper end of each of the solid electrolyte tubes, and
      (4) outlet means for removing molten metal in the collection zone from the cell; and
   (c) an electrolyte circulation zone beneath the upper horizontal partition comprising
      (1) a plurality of positive pole assemblies, each connected with positive current collector means, positioned concentrically to the outer longitudinal surface of each of the solid electrolyte tubes, (2) outlet means for removing gas from the electrolyte circulation zone near the top thereof, and (3) inlet means for feeding electrolyte feed materials into the circulation zone, the improvement which comprises at least one opening in each riser at approximately the same level as the top of its electrolyte tube for visually detecting the rate of flow of molten metal from the tube to the molten metal zone.

5. The cell of claim 4 wherein the opening is a substantially circular orifice in the riser wall.

6. The cell of claim 4 wherein the opening is a weir formed at the upper end of the riser wall.

* * * * *